US006718679B2

(12) United States Patent
Herzog

(10) Patent No.: US 6,718,679 B2
(45) **Date of Patent: *Apr. 13, 2004**

(54) FIREARM SAFETY SYSTEM

(75) Inventor: Raanan Herzog, Menashe (IL)

(73) Assignee: Spid (2002) Corp., Woodmere, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/300,861

(22) Filed: Nov. 20, 2002

(65) Prior Publication Data

US 2003/0163941 A1 Sep. 4, 2003

Related U.S. Application Data

(63) Continuation of application No. 10/087,085, filed on Mar. 1, 2002, now Pat. No. 6,499,243.

(51) Int. Cl.[7] ..... F41A 17/06
(52) U.S. Cl. ..... 42/70.07
(58) Field of Search ..... 42/70.07, 70.01, 42/70.06

(56) References Cited

U.S. PATENT DOCUMENTS

| | | | |
|---|---|---|---|
| 989,817 | A | 4/1911 | Siegel |
| 3,222,809 | A | 12/1965 | Bryan |
| 3,324,587 | A | 6/1967 | Bryan |
| 4,970,819 | A | 11/1990 | Mayhak |

*Primary Examiner*—Charles T. Jordan
*Assistant Examiner*—Bret Hayes
(74) *Attorney, Agent, or Firm*—Skadden, Arps, Slate, Meagher & Flom LLP

(57) ABSTRACT

A firearm safety system restricts the use of the firearm by reference to biometric data received by a sensor coupled to the firearm trigger. The biometric data is compared to at least one record of biometric data associated with a permitted user to determine whether firearm actuation is permitted. Firearm actuation is controlled by an anchor that is pivotally coupled to the firearm trigger. Firearm actuation is prevented when the anchor is extended between the trigger and the trigger aperture. Firearm actuation is permitted when the anchor is retracted in response to a positive identification by the sensor.

19 Claims, 6 Drawing Sheets

FIREARM SAFETY SYSTEM

CROSS-REFERENCE TO RELATED APPLICATIONS

This application claims priority to and is a continuation of U.S. application Ser. No. 10/087,085, now U.S. Pat. No. 6,499,243, entitled "Firearm Safety System," filed on Mar. 1, 2002.

FIELD OF THE INVENTION

The present invention relates to firearm safety and, more particularly, to restricting the actuation of a firearm by reference to user biometric data.

BACKGROUND OF THE INVENTION

Gun safety is a paramount issue in today's society. Advocacy groups on both sides of the "Gun Control" issue support the development of devices which prevent unauthorized gun use. Such restrictions are commonly endorsed as means for preventing gun use by children and criminals. Accordingly, efforts have been made to incorporate firearms with devices, which restrict or control use.

Several devices have been developed to address this need for firearm safety devices. For instance, U.S. Pat. Nos. 4,467,545, 5,502,915, and 5,603,179 disclose gun safety devices, which use finger or hand print data in identifying authorized users and enabling operation. Similarly, U.S. Pat. Nos. 5,570,528, and 5,459,957 disclose gun safety devices, which use voice recognition circuitry for identifying authorized users and enabling operation.

Some of the above firearm safety devices operate on the firearm's safety latch, whereby the safety latch can only be disabled by an authorized user. However, the safety latch is an important element of a firearm, which allows an authorized user to disable the firearm so as to prevent accidental firing. Any modifications to the safety latch, which automatically disengage the latch on positive identification of the user, remove an essential feature of the firearm and are thus undesirable. Moreover, the safety latch is not an essential element of the firing mechanism, allowing for circumvention of the devices while an operational firearm remains.

Other existing systems utilize a magnet, or other electromechanical element coupled to the firing hammer to enable or disable firing of the gun. To utilize these prior art devices with existing guns, the guns must be disassembled to install the necessary hardware. Such disassembly, installation of the appropriate hardware, and reassembly of the gun may be difficult to accomplish, resulting in underutilization of the safety devices.

Therefore, there is a need for a firearm safety system that does not require disassembly of the firearm, does not tamper with the firearm safety latch, and controls the actuation of a firearm by reference to an essential element of the firing mechanism.

SUMMARY OF THE INVENTION

Therefore, in accordance with the present invention, a system for restricting use of a firearm is presented which does not require disassembly of the firearm and is targeted at disabling an essential element of the firing mechanism, namely the trigger, rather than the safety latch. The safety system further makes use of a person's fingerprint data, which is a unique personal property that is highly suitable for tracking and control.

In one embodiment, the invention provides a firearm safety system for a firearm that includes a mechanical activator. The safety system includes a sensor, which has a reading surface, and which is coupled to the mechanical actuator of the firearm. The sensor is adapted to receive biometric data by a user placing at least a portion of its finger on the reading surface of the sensor. The safety system also includes a latch electrically coupled to the sensor, which receives at least a control signal from the sensor to disengage the latch to an open position. The latch is adapted to control the displacement of an anchor element. Finally, the safety device includes an anchor element rigidly coupled to the mechanical actuator of the firearm to prevent the displacement of the mechanical actuator when the anchor is in an extended position and to allow the displacement of the mechanical actuator when the anchor is in a retracted position. Preferably, the anchor is movable to a retracted position when the latch is in the open position.

In another embodiment, the invention provides a firearm safety system for a firearm that includes a trigger. The safety system includes a biometric sensor positioned on the forward facing portion of the firearm trigger so as to mate with the print portion of a user's finger when actuating the firearm. The sensor is electrically coupled to an electromechanical latch. The safety system also includes an anchor element pivotally couple to the rearward facing portion of the firearm trigger. The anchor element prevents the actuation of the firearm when in a first position. The safety system includes a first spring element coupled between the sensor and an anchor element, forcing the anchor element to a retracted position. Finally, the safety system includes an electro-mechanical latch, which maintains the anchor element in an extended position to prevent the actuation of the firearm. The electro-mechanical latch responding to a control signal from the sensor so as to allow the anchor element to move to the retracted position and allow for the actuation of the firearm.

In yet another embodiment, the invention provides a firearm safety system for a firearm that includes a trigger, whereby displacement of the trigger activates the firearm. The safety system includes a sensor, coupled to the firearm trigger, which receives biometric data associated with a user's fingerprint. The safety system also includes a comparator, which is electrically coupled to the sensor to compare at least one allowable biometric data record to the biometric data received by the sensor. The comparator provides an active signal in response to a positive comparison of the biometric data. The safety system further includes a latch, which is electrically coupled to the comparator to receive control signals from the comparator. The latch allows an anchor to move to a retracted position in response to an active signal from the comparator. Finally, the safety system includes an anchor pivotally coupled to the firearm trigger, which prevents the firearm actuating displacement of the trigger when in an extended position.

In an alternate embodiment, the invention provides a method for restricting the use of a firearm. The method includes providing a biometric sensor element on the firearm trigger, which is adapted to receive biometric data from an intended user of the firearm. The sensor includes memory for storing at least one biometric data record associated with a permitted user of the firearm, the sensor provides an active signal to an output in response to a positive comparison between received biometric data and the stored biometric data record. Finally, the method includes providing an electro-mechanical anchoring mechanism, which is rigidly coupled to the firearm trigger, and which is electrically coupled to the sensor. The anchoring mechanism is controlled by reference to the output signal from the sensor. The anchoring mechanism allows for the actuation of the firearm by trigger displacement when receiving an active signal from the sensor.

DETAILED DESCRIPTION OF THE INVENTION

Figure 1:
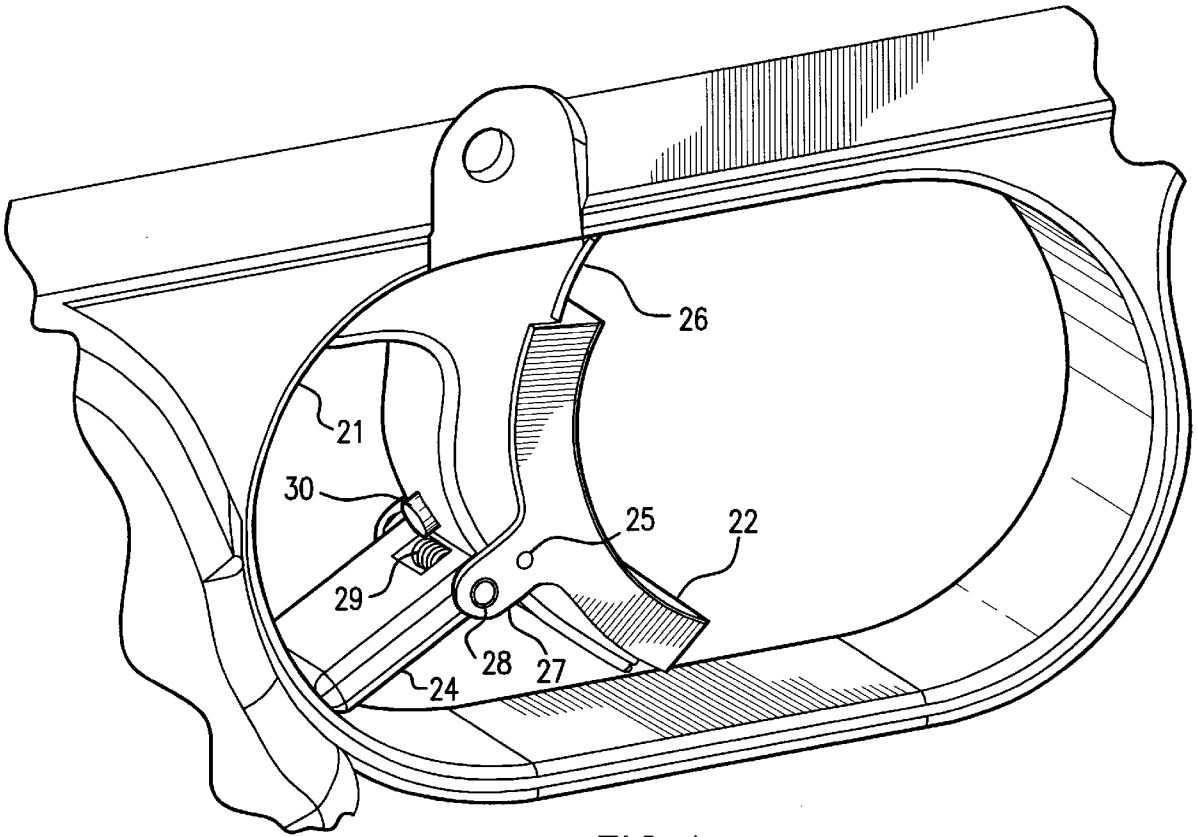
FIG. 1 illustrates a trigger aperture including a trigger that is fitted with a safety device in accordance with the invention.

FIG. 1 illustrates a trigger aperture 21 including a trigger 26, which is fitted with a safety device of the invention. The safety device is preferably coupled to the trigger 26 so as to prevent a displacement of the trigger, which results in an actuation of the firearm when the safety device is engaged in a locked position. The safety device includes a sensor housing 22 that is preferably mounted on the forward facing portion of the trigger 26. The sensor housing 22 is rigidly coupled to the trigger 26 by a pair of bolts 25, passing through the side of the sensor housing. Each bolt 25 advantageously includes a breakable head such that after the bolt is inserted to its final position, the bolt head is snapped off to prevent the removal of the bolt, and consequently, prevent the removal of the safety device. The sensor housing 22 is further pivotally coupled to an anchor 24.

The anchor 24 is pivotally coupled to the sensor housing 22 such that the anchor is provided in either an extended position, which prevents the actuation of the firearm, or in a retracted position, which allows for the actuation of the firearm. The anchor 24 is preferably positioned within the trigger aperture 21 of the gun so as to prevent the backwards movement of the trigger 26 by rigidly engaging the periphery of the trigger aperture when such movement is attempted. The anchor 24 is preferably coupled to the sensor housing connecting arms 27 by a pin 28 that is inserted through the edge of the anchor and the connecting arms. A spring 29 is preferably provided around the circumference of the pin to force the anchor 24 to a retracted position.

A latch is provided in a position extending from the sensor housing through the rearward facing portion of the trigger. In one embodiment, the latch is an electrically controlled solenoid. The solenoid center pin 30 is extended in the absence of an active signal at its input. When an active signal is received by the solenoid, the solenoid pin 30 is retracted. Accordingly, the retraction and extension of the solenoid pin 30 facilitates the operation of a latch, which controls the anchor's movement. In another embodiment, the latch is provided by an electromagnetic element, which extends from the rearward facing portion of the trigger 26 substantially parallel to a magnetic portion of the anchor 24. The electromagnetic element is controlled so as to maintain the anchor 24 is an extended position until it receives an active signal at an input.

In operation, when the latch is in the locked position, the solenoid pin 30 maintains the anchor 24 extended away from the trigger 26 substantially perpendicular to the longitudinal axis of the trigger so as to restrict the actuation of the firearm. To facilitate the locking, the solenoid pin 30 is extended in contact with the anchor substantially perpendicular to the anchor 24. When an authorized user is detected by the sensor 23, an active signal is provided to the solenoid. The solenoid pin 30 is then retracted to allow the anchor 24 to move to the retracted position, substantially parallel to the longitudinal axis of the trigger 26, thus allowing for the actuation of the firearm.

Figure 2:
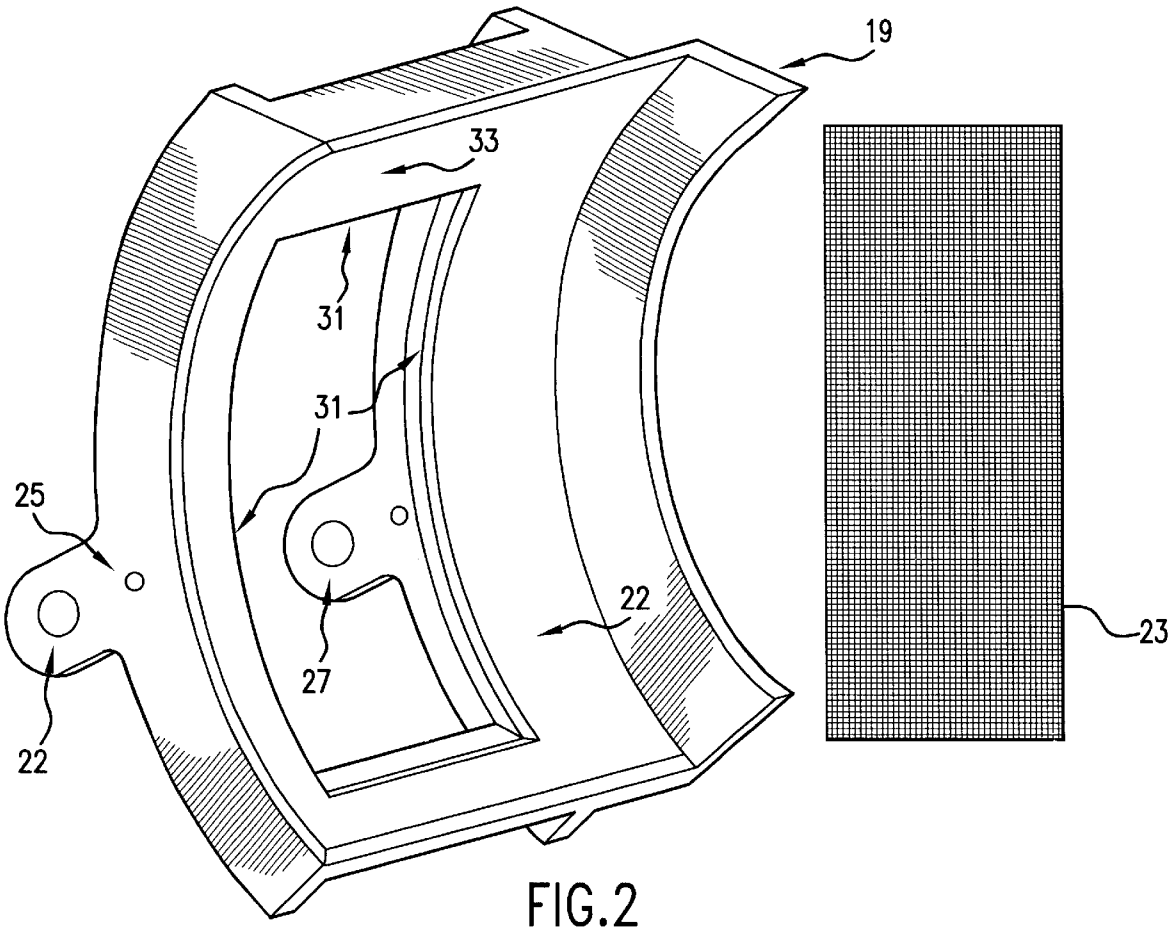
FIG. 2 illustrates the sensor housing of the safety device of FIG. 1.

FIG. 2 illustrates the sensor housing of the safety device of FIG. 1. The sensor housing 22 preferably includes a stopper flange 19 that ensures that a user's finger is provided in a consistent position along the sensor's input portion. The location (left or right) and position of the stopper flange 19 are preferably adjustable according to user convenience. The sensor housing 22 is adapted to retain a sensor 23 in a central cavity portion 31. The sensor housing 22 includes a portion 33 adapted to contain a battery, which provides power to the electronic components of the safety device. The sensor housing 22 further includes a pair of connecting arms 27 to pivotally couple to the anchor 24 by a connecting pin that is inserted through the connecting arms and the anchor.

The sensor 23 preferably provides an active signal in response to detecting biometric data that is associated with an authorized user. The biometric data is derived by sensing characteristics of a user's fingerprint. In one embodiment, the sensor 23 is an optical sensor that senses an optical image of the fingerprint. In another embodiment, the sensor 23 is a semiconductor sensor that senses data derived by measuring capacitances associated with contours of the user's fingerprint. The sensor signal resulting from a positive comparison of biometric data is preferably provided to the electro-mechanical latch, which controls the movement of the anchor 24. The sensor 23 is preferably a solid-state, silicone-based capacitive Fingerprint sensor from Veridicom Inc. of Sunnyvale, Calif. In the illustrated embodiment, the sensor 23 includes internal memory and comparison circuit, which is used to determine whether the received biometric data is associated with an authorized user.

In one embodiment, the sensor 23 compares the received biometric data to a single record of biometric data that is internally stored in local memory (not shown). In another embodiment, discussed with reference to FIG. 7, the sensor 23 compares the received biometric data to several records of data, which are stored in a memory module. The comparison of biometric data is preferably preformed by a comparator circuit (not shown) which is associated with the sensor 23. In one embodiment, the comparator circuit generates a match criteria score for received biometric data. When the match criteria score is beyond a predetermined threshold, a positive match signal is provided by the comparator circuit. In one embodiment, the matching criteria is provided as a percent match threshold level, which in part depends on the quality of components in the safety device. For example, when employing a high resolution sensor, the matching criteria may be increased from that used when employing a low resolution sensor.

Figure 3:
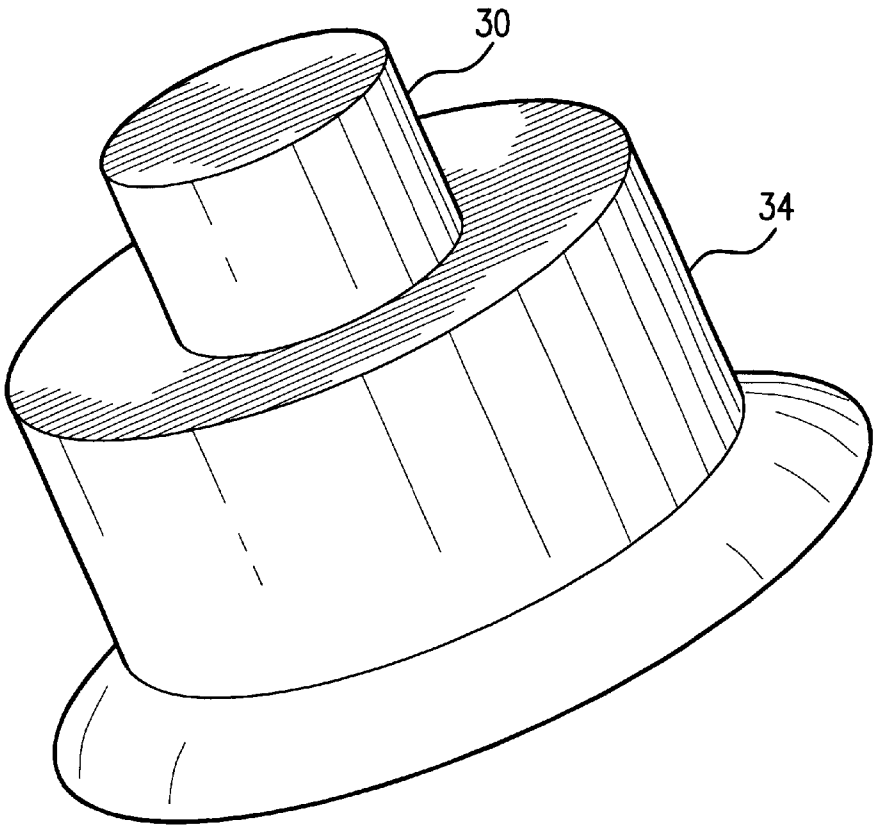
FIG. 3 illustrates the solenoid of the safety device of FIG. 1.

FIG. 3 illustrates the solenoid of the safety device of FIG. 1. The solenoid 34 includes a pin that is retracted by the activation of the solenoid, as is known in the art. The solenoid 34 preferably further includes a mechanism (not shown) for returning the pin 30 to an extended position.

Figure 4:
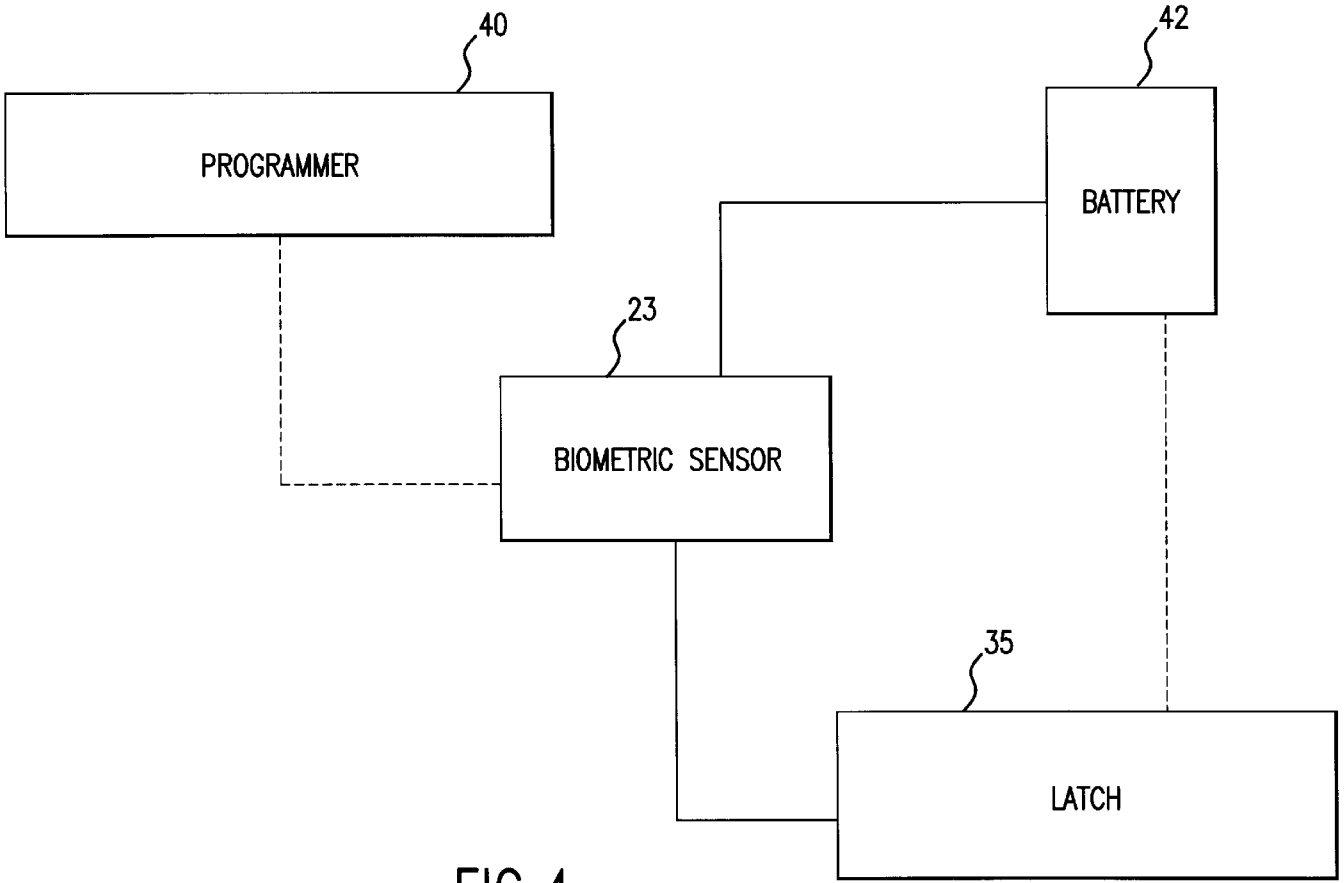
FIG. 4 illustrates the logical components associated with an embodiment of a safety device of the invention.

FIG. 4 illustrates a logical configuration of elements in a safety device of the invention. The safety device includes a sensor element 23 that is electrically coupled to a battery 42 and a latch 35. The battery 42 provides power to the sensor element to allow for comparing received biometric data to stored biometric data and for generating an active signal in response to positive comparison. As discussed above, the sensor element 23 includes a comparison circuit and a memory to store at least one biometric data record. The latch 35 is electronically controlled by the sensor so as to allow for retracting the anchor 24 in response to an active signal from the sensor. In one embodiment, the active signal also provides the power required to disengage the latch 35. In another embodiment, the latch 35 receives power by a direct connection to the battery 42.

A programmer unit 40 is preferably removably coupled to the sensor 23 to control the sensor during a programming mode of the safety device. During the programming mode, the sensor 23 receives biometric data associated with at least one authorized user. The received biometric data is stored by the sensor 23 in an internal memory (not shown). During an operating mode, the sensor 23 receives biometric data, which is compared to the stored data in the internal memory so as to control access to the firearm actuation mechanism.

Figure 5:
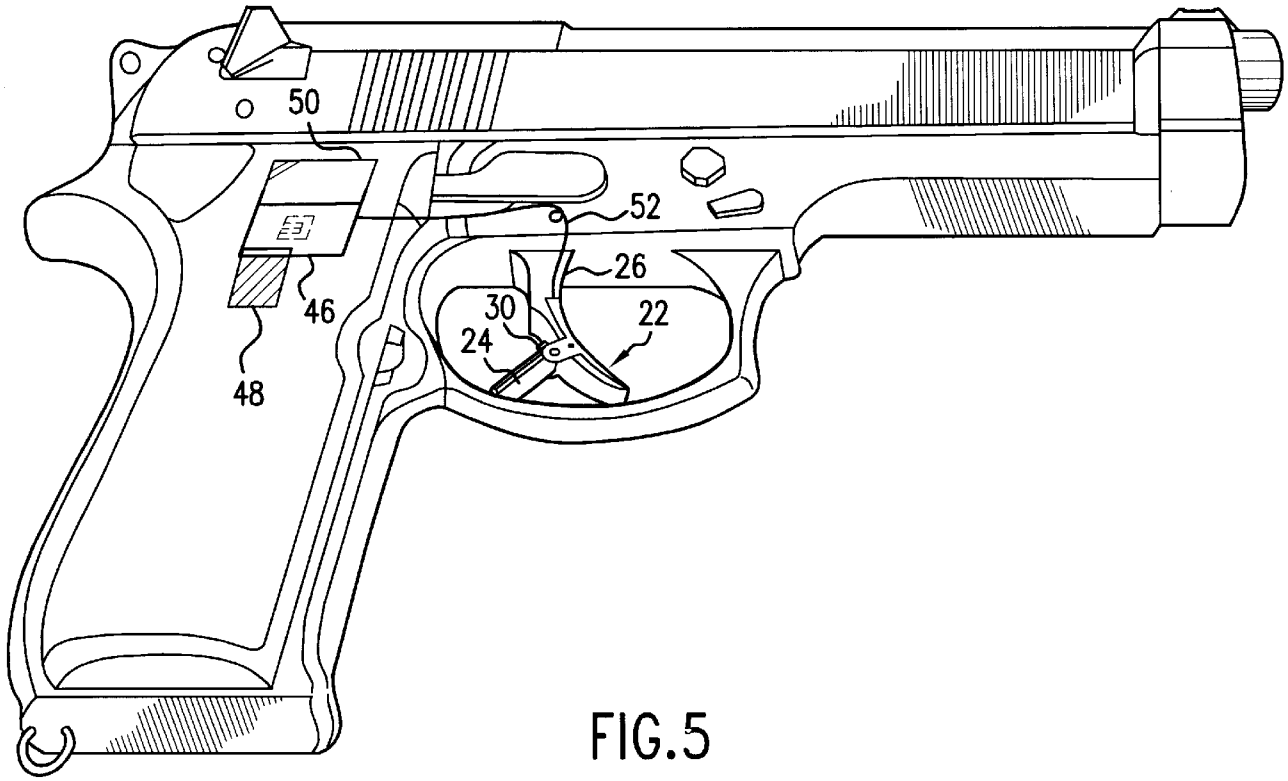
FIG. 5 illustrates a firearm that is fitted with a safety device in accordance with an alternate embodiment of the invention.

FIG. 5 illustrates an alternate arrangement of a safety device of the invention. The safety device of FIG. 5 includes a reading module 46, in addition to the elements of the safety device of FIG. 1, which receives a memory card 50, storing biometric data for at least one authorized user. The reading module 46 is preferably coupled to the firearm's butt portion. The reading module is preferably coupled to the sensor housing 22 by a communication wire 52. In one embodiment, the communication wire 52 includes a fiber optic cable. In another embodiment, the communication wire 52 includes a plurality of wires associated with data and power lines.

In one embodiment, the reading module 46 is adapted to receive a programmable "smart-card" 50. The card 50 preferably includes a memory chip that is adapted to store data. In another embodiment, the card 50 is a processor card that includes both memory and a processor to facilitate the search and comparison algorithms employed by a device in accordance with the invention. Such smart-cards are available from GEMPLUS of Senningerberg, Luxembourg.

The card 50 is preferably programmed by an external biometric data programmer. Such programmers are available from Veridicom of Sunnyvale, Calif. The sensor 23 employs the data stored in the card to determine whether received biometric data is associated with an authorized user. The sensor 23 preferably retrieves biometric data stored in the card 50 and provides each such data record to a comparison circuit operating in accordance with a predetermined matching criteria. In the illustrated embodiment, an external circuit 48 is provided to retrieve and compare data from the card 50.

Figure 6:
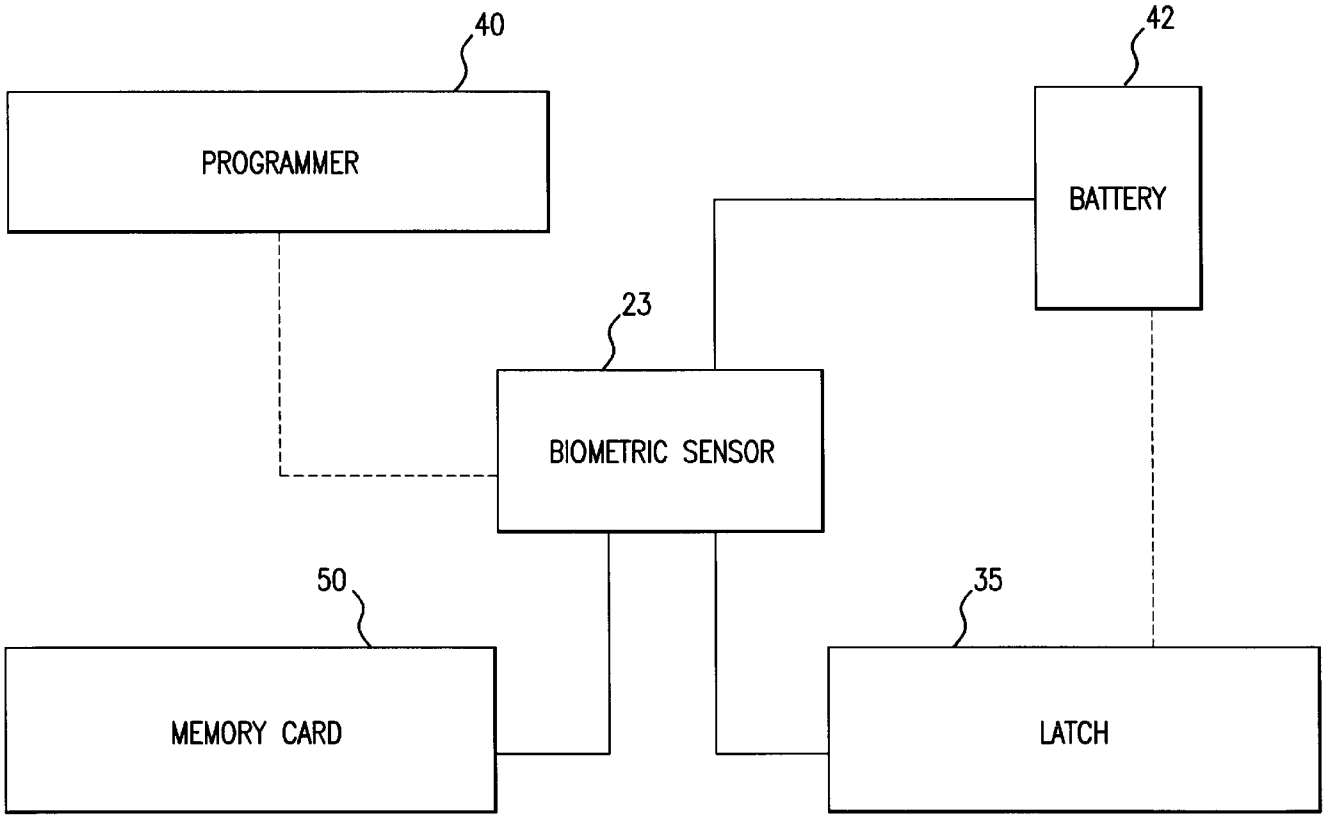
FIG. 6 illustrates the logical components associated the safety device of FIG. 5.

FIG. 6 illustrates the logical arrangement of components in the safety device of FIG. 5. The sensor 23 is coupled to a battery to provide power for the sensor's operation. The sensor 23 is further coupled to the control port of a latch 35. The control signal to the latch 35 preferably includes power required by the latch for executing the requested operation. The sensor 23 is further coupled to the memory card 50 for retrieving biometric data associated with authorized users. In one embodiment, the card 50 carries biometric data for a single user that intends to use the firearm. Thus, the user can employ different firearms by replacing the card associated with the user's biometric data in the desired firearm. In one embodiment, an external programmer 40 is removably coupled to the sensor to allow for storing biometric data in the card by employing the sensor as a data reception device.

Although the present invention was discussed in terms of certain preferred embodiments, the invention is not limited to such embodiments. For example, the system of the present invention is easily adapted to be used with firearms that do not have a gap between the rear of the trigger and the trigger aperture. For such firearms, the anchor is a split anchor that engages the firearm butt portion.

A person of ordinary skill in the art will appreciate that numerous variations and combinations of the features set forth above can be utilized without departing from the present invention as set forth in the claims. Thus, the scope of the invention should not be limited by the preceding description but should be ascertained by reference to claims that follow.

What is claimed is:

1. A firearm safety system, the firearm including a trigger, comprising:

a sensor coupled to the trigger of the firearm, the sensor including a reading surface, the sensor adapted to receive biometric data by a user placing at least a portion of its finger on the reading surface of the sensor;

a latch electrically coupled to the sensor, the latch receiving at least a control signal from the sensor to disengage the latch to an open position, the latch adapted to control the displacement of an anchor element; and an anchor element rigidly coupled to the trigger of the firearm to prevent the displacement of the trigger when the anchor is in an extended position and to allow the displacement of the trigger when the anchor is in a retracted position, the anchor is movable to a retracted position when the latch is in the open position.

2. The safety system of claim 1, wherein the latch comprises:

a solenoid rigidly coupled to the trigger of the firearm, the solenoid including a center pin, the center pin extending substantially parallel to the anchor when the anchor is in an extended position to prevent the anchor from moving to a retracted position, the solenoid retracting the center pin in response to an active signal from the sensor; and a spring element positioned between the sensor and the anchor element, the spring element forcing the anchor to a retracted position.

3. The safety system of claim 1, wherein the anchor directly prevents the actuation of the firearm by mechanically interposing between the trigger and portions of the firearm.

4. The safety system of claim 1, wherein the sensor is a silicone biometric fingerprint sensor.

5. The safety system of claim 1, wherein the sensor comprises:

a reading circuit to receiver biometric data from a user of the firearm;

a battery supplying power to the safety device, the battery electrically coupled to the reading circuit;

a memory, the memory element storing biometric data for at least one authorized user of the firearm; and a comparator circuit, the comparator circuit electrically coupled to the reading circuit and to the memory, the comparator circuit adapted to provide an active signal at the output of the sensor in response to a positive comparison between biometric data from the reading circuit and biometric data from the memory.

6. The safety system of claim 1, wherein the biometric sensor measures capacitance characteristics of a human fingerprint.

7. The safety system of claim 1, wherein the sensor is an optical biometric sensor.

8. The safety system of claim 1, wherein the system is introduced to the firearm after manufacture.

9. The safety system of claim 8, wherein adding the safety system to a firearm does not require disassembly of the firearm.

10. The safety system of claim 8, wherein adding the safety system to a firearm does not require disassembly of the firearm.

11. A firearm safety system, the firearm including a trigger whereby displacement of the trigger activates the firearm comprising:

a sensor coupled to the firearm trigger, the sensor receiving biometric data associated with a user's fingerprint;

a comparator electrically coupled to the sensor to compare at least one allowable biometric data record to the biometric data received by the sensor, the comparator providing an active signal in response to a positive comparison of said biometric data;

a latch electrically coupled to said comparator to receive control signals from the comparator, the latch allowing an anchor to move to a retracted position in response to an active signal from the comparator; and an anchor pivotally coupled to the firearm trigger, the anchor preventing the firearm actuating displacement of the trigger when in an extended position.

12. The method of claim 11, wherein the anchor directly prevents the actuation of the firearm by mechanically interposing between the trigger and the trigger aperture.

13. The method of claim 11, wherein the sensor is a silicone biometric fingerprint sensor.

14. The method of claim 11, wherein the biometric sensor measures capacitance characteristics of a human fingerprint.

15. The method of claim 11, wherein the sensor is an optical biometric sensor.

16. The method of claim 11, wherein the system is introduced to the firearm after manufacture.

17. The method of claim 11, wherein adding the safety system to a firearm does not require disassembly of the firearm.

18. A method for restricting the use of a firearm, the firearm including a trigger comprising:

providing a firearm safety system on the firearm, the safety system including a biometric sensor element to receive biometric data from an intended user of the firearm, the safety system allowing actuation of the firearm by a displacement of the trigger in response to a positive identification of the intended user as a permitted user;

coupling a programming module to the safety system to set the safety system to a programming mode, the programming module controlling the biometric sensor to receive and store biometric data for a permitted user;

receiving biometric data from the permitted user; and decoupling the programming module from the safety system to set the safety system to an active mode.

19. A firearm safety system, the firearm including a trigger, comprising:

sensing means coupled to the trigger of the firearm, the sensing means adapted to receive biometric data by a user placing at least a portion of its finger on the sensing means;

latching means electrically coupled to the sensing means, the latching means receiving at least a control signal from the sensor to disengage the latching means to an open position, the latching means adapted to control the displacement of anchoring means; and anchoring means rigidly coupled to the trigger of the firearm to prevent the displacement of the trigger when the anchoring means is in a first position and to allow the displacement of the trigger when the anchor is in a second position, the anchoring means is movable to the second position when the latching means is in the open position.

* * * * *